US005099552A

United States Patent [19]

Kimbrough

[11] Patent Number: 5,099,552

[45] Date of Patent: Mar. 31, 1992

[54] LACE DECORATING DEVICE

[75] Inventor: Richard Kimbrough, Sante Fe, N. Mex.

[73] Assignee: Brookside Products Limited, Kowloon, Hong Kong

[21] Appl. No.: 391,346

[22] Filed: Aug. 8, 1989

[51] Int. Cl.[5] ..... A43C 9/02

[52] U.S. Cl. ..... 24/715.6

[58] Field of Search ..... 16/122; 24/713.1, 715.4, 24/715.5, 715.6, 715.7, 129 R, 129 D

[56] References Cited

U.S. PATENT DOCUMENTS

| | | | |
|---|---|---|---|
| D. 292,442 | 10/1987 | Wadsworth . | |
| 1,823,412 | 9/1931 | Schwarze | 24/715.4 |
| 2,273,136 | 2/1942 | Orech et al. | 24/129 R X |
| 2,308,286 | 1/1943 | Joyce | 24/129 D |
| 2,612,135 | 11/1950 | Iny . | |
| 2,961,727 | 11/1960 | Coffey | 24/715.6 |
| 3,066,370 | 2/1961 | Epstein . | |
| 3,473,198 | 9/1967 | Meier . | |
| 3,500,508 | 5/1968 | Bennett . | |
| 3,957,237 | 5/1976 | Campbell | 24/129 R X |
| 4,485,529 | 12/1984 | Blum . | |
| 4,805,270 | 2/1989 | Kimbrough . | |

*Primary Examiner*—James R. Brittain

*Attorney, Agent, or Firm*—Blum Kaplan

[57] ABSTRACT

A device for decorating laces formed from a body having a first bore extending from a first end of the body to a second end of the body and a second bore extending from the second end of the body. The tip of a lace passes through the first bore from the first end to the second end and is then received in the second bore and retained therein when the end of the lace extending past the first end is pulled. A full or partial wall is defined between the bores in the vicinity of the first end for retaining a loop of the lace. A groove may be formed in the second end between the first and second bores for receiving the loop of the lace.

11 Claims, 1 Drawing Sheet

LACE DECORATING DEVICE

BACKGROUND OF THE INVENTION

The present invention is directed to decorating devices for the ends or tips of laces.

Over the ages, it has been common to decorate shoes with various devices. Children in particular are attracted to for the central region of a shoe, retained by the shoelace, are disclosed in U.S. Pat. Nos. 4,805,270 (Kimbrough), 4,485,529 (Blum), 3,473,198 (Meier) and 3,066,370 (Epstein). Each of these devices perform both a decorative function and a shoelace retaining function. Still another shoelace retaining arrangement but without a decorative arrangement is depicted in U.S. Pat. No. 3,500,508 (Bennett).

U.S. Pat. No. 2,612,135 (Iny) teaches an arrangement for attaching a bell to the end of a shoelace as a decorative device. The bell is retained on the end of the shoelace by a ball-like member 28 formed of a thermoplastic material. Member 28 is applied by heating to soften same and is then affixed to the end of the shoelace. This arrangement is cumbersome and difficult for young child to execute. Design U.S. Pat. No. 292,442 (Wadsworth) discloses a shoe decoration in the shape of the face of a character and formed with a bore therethrough. The precise method of using or affixing this structure is not clear.

None of the prior art arrangements satisfy the need for a shoelace decorating device suitable for decorating only the tips of the laces and which are readily applied and removed. By providing such an arrangement, the utility and play value of the shoelace decorating device is enhanced, since the user can have a plurality of sets of such devices and alter them as the user pleases.

SUMMARY OF THE INVENTION

Generally speaking, in accordance with the present invention, an improved lace decorating device is provided having a first bore extending therethrough from a first end to a second opposed end of the device and a second bore extending from the second end to a length sufficient to at least accommodate the tip of a lace. The first bore is dimensioned to permit the passage of the tip therethrough and to receive a length of the lace past the tip. The second bore is dimensioned to receive the tip of the lace, said bores being positioned to define at least a partial wall therebetween in the vicinity of the second end about which the lace extends when the tip is in the second bore. The device is intended for use with laces having relatively rigid tips. Such tips, when passed through the first bore from the first end to the second end and then inserted into the second bore, are retained in the second bore when the lace is pulled from the portion extending from the first side of the device. The body of the lace decorating device can be shaped as desired, such as the shape of an object or the face of a cartoon character.

Accordingly, it is an object of the invention to provide a lace decorating device which can be readily applied to and removed from the ends of a tipped lace.

Another object of the invention is to provide a lace decorating device permitting manufacture in a variety of shapes and configurations and readily interchangeably mounted on tipped laces.

A further object of the invention is to provide a lace decorating device which is securely retained on a tipped lace yet is readily removed therefrom when desired.

Still another object of the invention is to provide a device which will prevent the tips of laces to unintentionally pass back through the eyelet of the wearer's shoe.

Still other objects and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

FIG. is a perspective view of a shoe having one embodiment of the lace decorating device in accordance with the invention mounted thereon.

DESCRIPTION OF THE PREFERRED EMBODIMENTS

Figure 1:
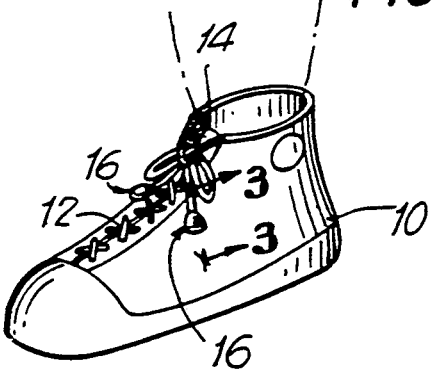
Figure 2:
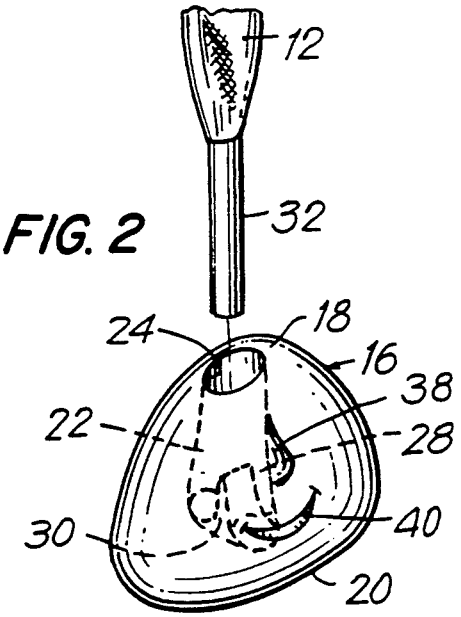
FIG. 2 is a perspective view of the lace decorating device of FIG. 1 shown in juxtaposition with but not secured to the end of a tipped lace.

Referring now to FIG. 1, the shoe 10 is provided with a lace 12 formed with a knot 14 and having a lace decorating device 16 secured to each end of lace 12. As more particularly shown in FIGS. 2–4, lace decorating device 16 is provided with a first narrower end 18 and a second wider end 20. A first bore 22 extends from an opening 24 in first end 18 to an elongated groove 26 extending along second end 20.

A second bore 28 extends at an acute angle to first bore 22 from groove 26 toward first end 18. Second bore 28 intersects and joins first bore 22 midway along its length and does not extend in a straight line to opening 24, although it communicates therewith. Bores 22 and 28 and groove 26 define an essentially triangular wall 30 therebetween.

Figure 3:
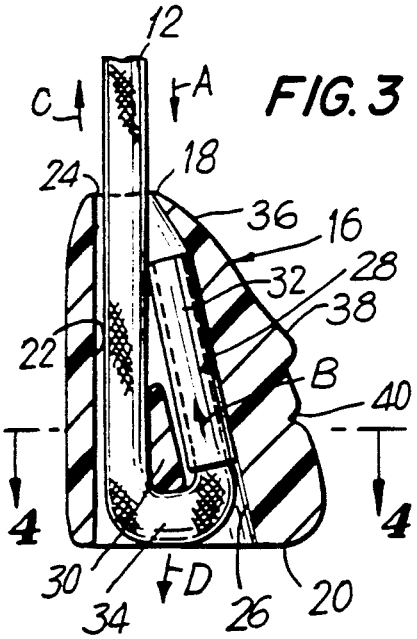
FIG. 3 is a section view taken along line 3—3 of FIG. 1.

Shoelace 12 is provided with an essentially rigid conventional tip 32 formed of a metal or plastic material. As more particularly shown in FIG. 3, the lace extends from opening 24 in first end 18 through first bore 22 to groove 26. The lace then extends across groove 26 around wall 30 and the tip 32 is inserted into second bore 28. To insert the lace in the device 16, the tip of the lace is passed through first bore 22 in the direction of arrow A (FIG. 3) through and out of groove 26. The tip 32 is then inserted through groove 26 into second bore 28 in the direction of arrow B (FIG. 3). The lace 12 is then pulled in the direction of the arrow C (FIG. 3) to pull up the slack while holding lace decorating device 16. In this way, the lace decorating device 16 is locked on to and is retained on the end of lace 12. To remove the device, it is merely necessary to pull on the loop region 34 of lace 12 which wraps around wall 30 and lies in groove 26. This pulling is in the direction of arrow D (FIG. 3) and serves to pull the tip 32 out of second bore 28 and a length of the lace 12 out of first bore 22. When the tip 32 is clear of second bore 28 and groove 26, it can be aligned with first bore 22. When so aligned, by pulling on lace 12 in the direction of arrow C, the lace can be separated from the lace retaining device.

Groove 26 is preferably dimensioned to permit the user to grab the loop 34 of the lace. While the arrangement is shown with the loop 34 retained in groove 26, that groove can be dispensed with so that wall 30 terminates at second side 20. In that arrangement, the loop 34 for the lace 12 projects beyond the end 20, a less sightly but nonetheless functional arrangement.

Shoelace retaining device 16 may be in any desired shape, preferably an ornamental shape which is suitable for decoration or has play view to a child user. In the case of the embodiment of FIGS. 1–4, lace decorating device 16 takes the shape of the face of a character, such as a cartoon character, having facial features formed in or painted on surface 36 extending between the first and second ends. By way of example, nose 38 and mouth 40 may be formed in surface 36 (FIG. 3).

Figure 5:
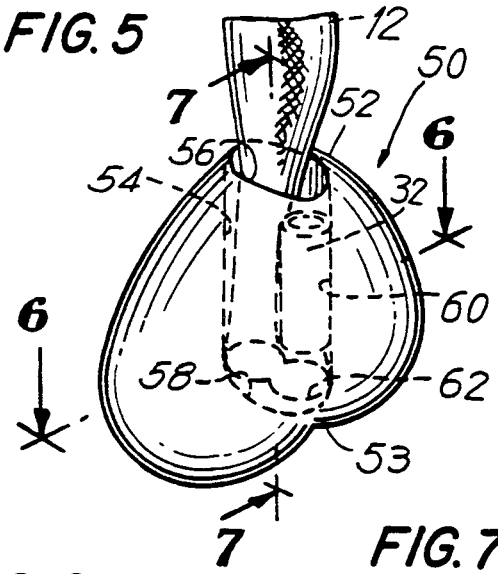
FIG. 5 is a perspective enlarged view of an alternate embodiment of the lace decorating device in accordance with the invention mounted on the end of a tipped lace.
Figure 6:
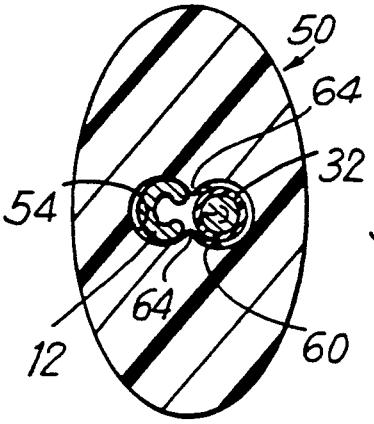
FIGS. 6 and 7 are sectional views taken along lines 6—6 and 7—7, respectively, of FIG. 5.
Figure 7:
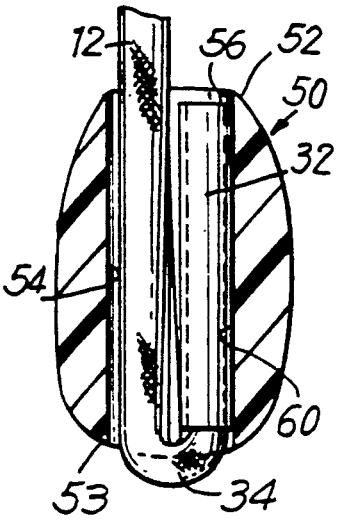

Referring now to FIGS. 5–7, a second embodiment of the lace decorating device in accordance with the invention is depicted. This embodiment of the device 50 is formed in the shape of a heart. The tip of the heart defines the first end 52 while the broader portion of the heart defines the second end 53. A first bore 54 extends from opening 56 in first end 52 to opening 58 in second end 53. A second bore 60 extends from opening 56 in first end 52 to opening 62 in second end 53. The first and second bores overlap along their entire length, but are at a slight angle to each other so that, in the region of second end 53, short partial walls 64 are defined between the bores 54 and 60 at openings 58 and 62 as more particularly shown in FIG. 6. These partial walls 64 are dimensioned and positioned, particularly at openings 58 and 62, to provide sufficient support so that a loop 34 of lace 12 is retained and prevented from passing through openings 58 and 62 when the tip 32 is in second bore 60 and a length of the lace 12 is in first bore 54 as more particularly shown in FIG. 7.

Bores 54 and 60 can be formed parallel to each other with the partial wall 64 extending along their full length for ease of manufacture. Further, the embodiment of FIG. 7 can be formed with a groove similar to groove 26 to accommodate the loop 34.

While the embodiment of FIGS. 5–7 is shown in the shape of a heart, any desired decorative shape can be utilized and the surface can be free of ornamentation or decorated by painting or other devices.

The lace decorating device is preferably formed of a unitary body of plastic material which may be readily molded. The device while simple and inexpensive is easy to use and provides, because of the ease of interchangeability, the opportunity for the user to freely substitute different shapes of the device in accordance with the invention, depending upon the whim and fancy of the user. Particularly in the case of children, this greatly enhances the play value of the device. Further, the device can be readily manipulated by a child and does not interfere with the tying of laces since it occupies a relatively short length of the end of the lace.

Figure 4:
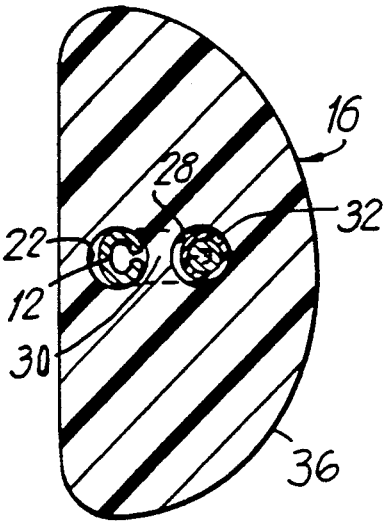
FIG. 4 is a section view taken along line 4—4 of FIG. 3.

The bores 22 and 54 are preferably dimensioned to accept normal-size laces but can be enlarged to accommodate larger thickness laces popular on certain types of shoes, particularly sneakers. Further, the bores 28 and 60 may be the same size as the respective bores 22 and 54, may be larger where the tip is larger than the lace or may be smaller where the tip is smaller than the lace. Since the substantially rigid tip 32 extends along essentially its entire length in the second bores 28 and 60, it is difficult to accidentally dislodge the device. This is especially true where the bores 22 and 54 accommodate the lace in a somewhat folded position as shown in FIGS. 4 and 6, so that the friction of the lace against the bores tends to hold the device in place and prevent displacement.

When applied, the lace decorating devices according to the invention stop the unintended passage of a lace out of the eyelet of the shoe, a feature particularly useful to children.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A lace with at least one removable decorating device comprising a lace having at least one end formed with a substantially rigid elongated tip; and a decorating device removably coupled to said at least one tipped end of said lace comprising a body having a first end ad a second opposed end, said body being formed with a first essentially straight bore extending from the first end to the second end, a second essentially straight bore extending from the second end toward the first end of a length sufficient to essentially receive said tip of said lace and positioned relative to the first bore to define at least in a region near the second end a wall means between the first and second bores, and a groove in the second end of said body extending at least between said first and second bores, said groove being dimensioned to receive a portion of said lace adjacent said tip while permitting the grasping thereof for removal of the device from the lace, whereby said tipped end of said shoe lace may pass through said first bore from the first end to the second end around said wall means and into said second bore for retention therein without requiring deformation of said tipped end when said lace is pulled from the portion projecting out of the first bore at the first end.

2. The lace and decorating device of claim 1, wherein said first and second bores define an acute angle therebetween having an apex in the direction of said first end.

3. The lace and decorating device of claim 1, wherein said first and second bores intersect in the vicinity of said second end to define a wall means comprising two partial wall portions of sufficient dimension to receive and retain a loop of the shoelace when the tip of the shoelace is in said second bore and the shoelace extends about said partial wall portions and through said first bore to said first end.

4. The lace and decorating device of claim 1, wherein said body is a unitary molded member.

5. The lace and decorating device of claim 1, and including a surface decorated to define a face.

6. The lace and decorating device of claim 5, wherein said face is molded in the shape of the features of a face.

7. The lace and decorating device of claim 1, wherein said body is shaped in a decorative shape.

8. The lace and decorating device of claim 7, wherein said decorative shape is a heart.

9. The lace and decorating device of claim 1, wherein said first bore is dimensioned to snugly receive said lace whereby the lace will not normally be displaced along the bore unless affirmatively pulled.

10. The lace and decorating device of claim 1, wherein said lace has two of said essentially rigid tipped ends, and a decorating device removably mounted on each of said essentially rigid tipped ends.

11. The lace and decorating device of claim 1, wherein said lace is a shoelace.

* * * * *